US007401889B2

(12) United States Patent
Iwasaki

(10) Patent No.: US 7,401,889 B2
(45) Date of Patent: Jul. 22, 2008

(54) LIQUID EJECTOR CLEANING METHOD AND LIQUID EJECTOR

(75) Inventor: Mitsutaka Iwasaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/594,500

(22) PCT Filed: Jan. 14, 2005

(86) PCT No.: PCT/JP2005/000405

§ 371 (c)(1),
(2), (4) Date: Sep. 28, 2006

(87) PCT Pub. No.: WO2005/100031

PCT Pub. Date: Oct. 27, 2005

(65) Prior Publication Data

US 2007/0182779 A1 Aug. 9, 2007

(30) Foreign Application Priority Data

Mar. 31, 2004 (JP) ..... 2004-103532

(51) Int. Cl.
*B41J 2/165* (2006.01)

(52) U.S. Cl. ..... 347/29; 347/30; 347/32; 347/23

(58) Field of Classification Search ..... 347/29, 347/30, 32, 23
See application file for complete search history.

(56) References Cited

U.S. PATENT DOCUMENTS 6,036,299 A * 3/2000 Kobayashi et al. ..... 347/30
6,302,531 B1 * 10/2001 Usui et al. ..... 347/86

FOREIGN PATENT DOCUMENTS

| | | | |
|---|---|---|---|
| JP | 6-328730 | A | 11/1994 |
| JP | 9-240016 | A | 9/1997 |
| JP | 11-348318 | A | 12/1999 |
| JP | 2000-218806 | A | 8/2000 |
| JP | 2003-182116 | A | 7/2003 |

* cited by examiner

*Primary Examiner*—Shih-Wen Hsieh
(74) *Attorney, Agent, or Firm*—Sughrue Mion, PLLC

(57) ABSTRACT

Recording head of a printer is sealed by a cap connected with a gear pump. Fluid is discharged from a nozzle through the cap by a negative pressure being generated by the gear pump. The gear pump is driven at a first rotational speed to suck the fluid in the cap and to discharge the fluid from the nozzle. Subsequently, the gear pump is driven at a second rotational speed lower than the first rotational speed and then it is stopped. This prevents backflow of the fluid to a liquid ejection head and breakage of a liquid meniscus in the nozzle of the liquid ejection head occurring when cleaning of the liquid ejection head is ended.

13 Claims, 4 Drawing Sheets

LIQUID EJECTOR CLEANING METHOD AND LIQUID EJECTOR

FIELD OF THE INVENTION

The present invention relates to a method for cleaning a liquid ejector and to a liquid ejector.

BACKGROUND OF THE INVENTION

Inkjet type recording devices (hereinafter referred to individually simply as a "printer") are widely known as liquid ejectors that eject liquid toward a target. A printer performs printing by ejecting ink, which serves as a liquid, from a recording head, which serves as a liquid ejection head. However, when the ink in a nozzle of a recording head becomes viscid or when bubbles enter the nozzle, there is a possibility that the printer cannot perform satisfactory printing. In order to avoid the occurrence of such a phenomenon, the incorporation of a head cleaning mechanism in the printer has been proposed. Such a head cleaning mechanism covers a nozzle open surface of the recording head and drives a pump, which is connected to the cap, when the printer is idle. Ink, bubbles, and fluid are suctioned out of the nozzle of the recording head by negative pressure, which is generated by the pump (refer, for example, to Patent Publication 1). A pump, such as a tube pump or a gear pump, may be used.

When performing head cleaning, a pump motor or the like is driven at a preset rotation speed to generate negative pressure such as to enable the suction of fluid from the nozzle.

Patent Publication 1: Japanese Laid-Open Patent Publication No. 2000-218806

SUMMARY OF THE INVENTION

However, there is a tendency for fluid backflow to occur in the pump. When such a pump is used, there is a possibility for the occurrence of a backflow of fluid (ink) from the pump to the cap, particularly, when the pump is stopped. When there is a backflow of fluid to the cap, the fluid may enter the nozzle of the recording head and contaminate the nozzle open surface.

Even in a pump that is relatively unlikely to generate a backflow, there is a possibility for the pressure in the cap to suddenly increase due to backflow of fluid from a tube, which is connected to the cap, into the cap when the pump stops operating and the suction operation ends. If the pressure in the cap suddenly increases when the recording head is still under a negative pressure, fluid, such as ink, air, and dust may be suctioned into the nozzle. When fluid in the cap flows back into (enters) the nozzle, this may result in unsatisfactory printing due to color mixing of the ink, mixing of bubbles and dust contamination, disruption of the surface (meniscus) of the ink in the nozzle, and other reasons.

It is an object of the present invention to provide a method for cleaning a liquid ejector and a liquid ejector that prevents a backflow of fluid to a liquid ejection head when ending liquid ejection head cleaning and prevents disruption of the meniscus of the liquid in a nozzle of the liquid ejection head.

To achieve the objects described above, the present invention provides a method for cleaning a liquid ejector. A liquid ejection head ejects liquid from a nozzle. The liquid ejection head is sealed by a cap means connected to a gear pump. The gear pump generates negative pressure. The negative pressure discharges fluid from the liquid ejection head. The gear pump suctions fluid from the cap means so that suction amount of the fluid per unit time becomes equal to a first suction amount. After fluid is discharged from the nozzle, fluid is suctioned from the cap means by changing the suction amount of the fluid per unit time from the first suction amount to a smaller second suction amount.

Thus, after a gear pump has suctioned fluid from the cap means such that the fluid suction amount per unit time from the cap means is a first suction amount, the gear pump suctions fluid from the cap means, such that the fluid suction amount per unit time from the cap means is a second suction amount that is less than the first suction amount. That is, after the gear pump has reduced the pressure in the cap means through the suction operation in the first suction amount to and discharged the fluid from the nozzle of the recording head, the gear pump mitigates the negative pressure state in the cap means through the suction operation in the second suction amount. As a result, the generation of a backflow of fluid from the gear pump to the cap means is prevented when the gear pump stops the suction operation. Therefore, a sudden increase in the pressure of the cap means that would be caused by fluid backflow is prevented. Thus, fluid is prevented from entering the nozzle of the liquid ejection head after the fluid has been discharged by the cleaning, and disruption of the meniscus of the liquid in the nozzle is also prevented.

The present invention further provides a liquid ejector. The liquid ejector is provided with a liquid ejection head for ejecting liquid from a nozzle. The liquid ejection head is sealed by a cap means connected to a gear pump. The gear pump suctions fluid from the cap means so that the suction amount per unit time of the fluid from the cap means becomes equal to a first suction amount. Thus, after fluid is discharged from the nozzle, the suction amount of the fluid from the cap means per unit time is changed to a second suction amount, which is less than the first suction amount.

Accordingly, after the gear pump has suctioned liquid from the cap means such that the liquid suction amount per unit time from the cap means becomes equal to a first suction amount, the gear pump suctions liquid from the cap means such that the liquid suction amount suctioned per unit time from the cap means is a second suction amount that is less than the first suction amount. That is, after the gear pump has reduced the pressure in the cap means through the suction operation of the first suction amount and discharged the liquid from the nozzle of the recording head, the gear pump mitigates the negative pressure state in the cap means through the suction operation in the second suction amount. As a result, the generation of a backflow of fluid from the gear pump to the cap means is prevented when the gear pump stops the suction operation. Accordingly, the backflow of fluid in the nozzle of the liquid ejection head caused by the liquid backflow is prevented, and disturbance of the meniscus of the liquid in the nozzle is prevented.

In the liquid ejector, the gear pump is driven so that the suction amount from the cap means per unit time is equal to a first suction amount order to discharge fluid from the nozzle. Thereafter, the gear pump is stopped after the gear pump has been driven so that the suction amount from the cap means per unit time is a second suction amount.

Thus, after the gear pump has been driven so as to suction liquid from the cap means at a first suction amount per unit time from the cap means, the gear pump is driven so as to suction fluid at the second suction amount per unit time that is less than the first suction amount and then stopped. Therefore, the negative pressure state in the cap means is mitigated by suctioning a second suction amount even when a negative pressure has accumulated in the cap means that is large enough to enable the discharge of fluid in the cap means from the nozzle through the suctioning in the first suction amount. Accordingly, backflow of the liquid from the gear pump to the cap means is prevented even when the gear pump is stopped, and a sudden increase of pressure in the cap means is prevented. The fluid in the cap means is therefore prevented from flowing back into the liquid ejection head. For example, the suction amount from the cap means may be changed by changing the pump drive mode, such as rotation speed or the like.

In the liquid ejector, after the gear pump has been driven at a first rotation speed and fluid within the cap means has been suctioned at a first suction amount, the gear pump is driven at a second rotation speed lower than the first rotation speed and the fluid in the cap means is suctioned at the second suction amount. Thereafter, the gear pump stops.

Thus, a relatively large negative pressure is generated in the upstream portion of the gear pump, which improves the nozzle cleaning capability. Furthermore, the amount of fluid suctioned from the cap means is changed by just changing the rotation speed of the rotation volume pump.

In the liquid ejector, the gear pump includes a housing and two gears accommodated in the housing.

Thus, the gear pump structure is simple and compact. When adjusting the fluid suction amount, the amount of liquid suctioned from the cap means is changed after having driven the gear pump at the first rotation speed by driving the gear pump at the second rotation speed that is lower than the first rotation speed. Thus, the control of the gear pump is relatively simple.

The liquid ejector includes a detecting means for detecting an increase and decrease in the load of the gear pump caused by a flow of fluid into the gear pump and a flow of liquid out of the gear pump. After the detecting means has detected an increase in the load on the gear pump, the gear pump changes the suction amount from the cap means per unit time from a first suction amount to a second suction amount.

In this way, after the detecting means detects an increase in the load on the pump, the gear pump changes the suction amount per unit time from the first suction amount to the second suction amount and then suctions the fluid. Therefore, after the fluid is definitely discharged from the liquid ejection head, the gear pump reduces the suction amount per unit time so as to mitigate the negative pressure state in the cap means. This improves the reliability of the operation for suctioning liquid from the liquid injection head.

The liquid ejector includes a flow passage for guiding liquid to a nozzle, and a valve device arranged upstream from the nozzle in the flow passage. The valve device includes a pressure chamber for storing liquid and a flexible member displaced by a pressure difference between the interior and exterior of the pressure chamber. The displacement of the flexible member opens and closes the valve device.

Thus, the valve device opens and closes due to the displacement of the flexible member in accordance with the pressure difference between the interior and exterior of the pressure chamber in which the liquid is stored to adjust the amount of liquid supplied to the nozzle. The valve device differs from a type that opens and closes by using an actuator driven by electric power inasmuch as the valve device stably supplies liquid to the nozzle and the device itself has a simple structure. When the suction operation of the gear pump for the cap means is stopped, the negative pressure state in the cap means is mitigated due to the suction in the second suction amount prior to the gear pump being stopped. This decreases the displacement amount of the flexible member. Thus, the change in volume caused by the flexing of the flexible member becomes small, and the suction amount of fluid from the nozzle surface due to the change in volume caused by the elastic restoration of the flexible member is small. Accordingly, disruption of the meniscus at the nozzle is prevented, and liquid is discharged from the nozzle in a satisfactory condition.

DETAILED DESCRIPTION OF THE PREFERRED EMBODIMENTS

Figure 1:
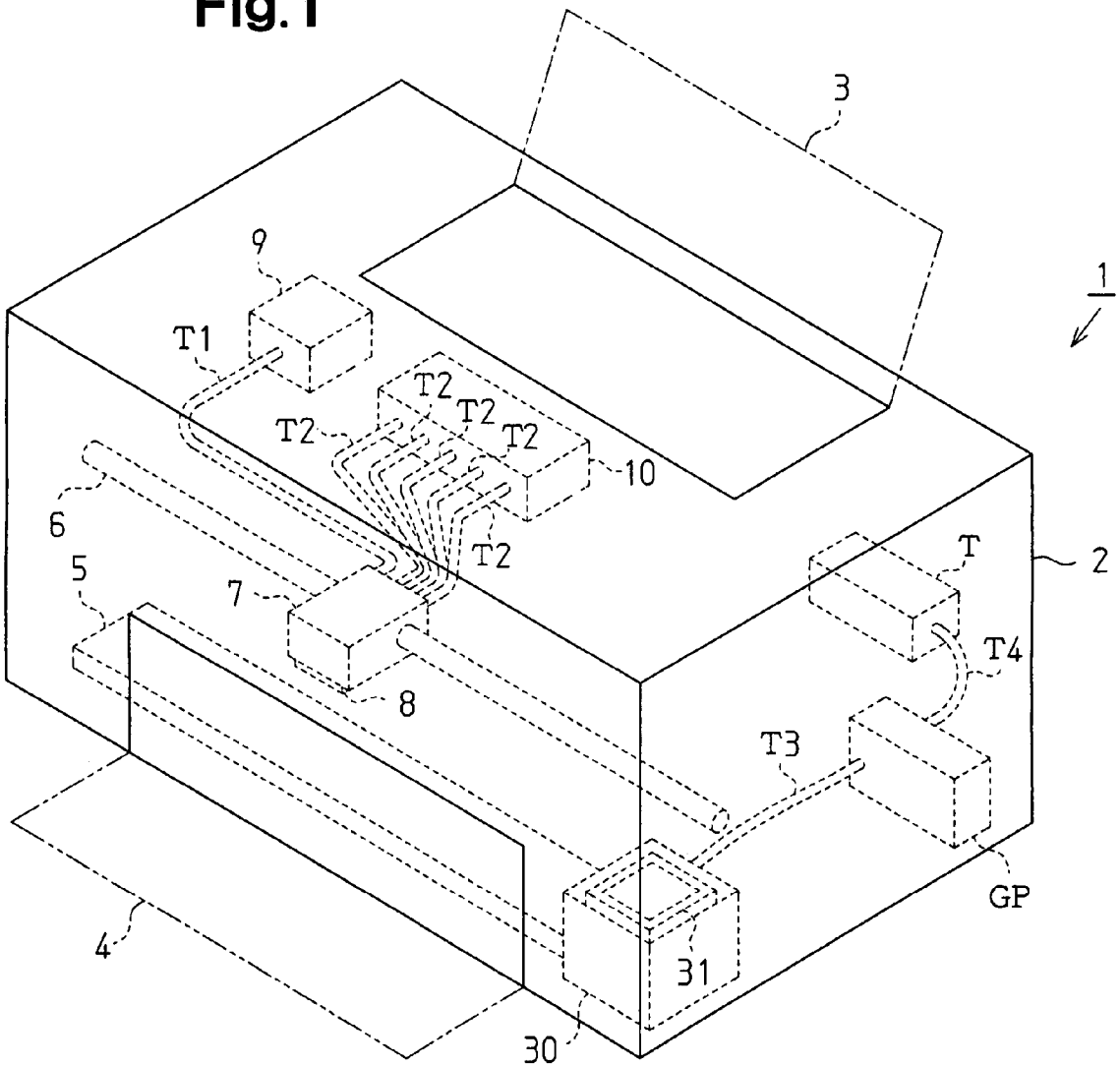
FIG. 1 is a perspective view showing a printer according to one embodiment of the present invention.

One embodiment of the present invention will be described hereinafter with reference to FIGS. 1 through 5. FIG. 1 is a schematic perspective view showing an inkjet recording device (hereinafter referred to simply as "printer"), which serves as a liquid ejector.

As shown in FIG. 1, a printer 1 includes an outer case 2 and a platen 5, which is arranged in the outer case 2. A recording sheet (not shown), which serves as a target, is fed from a paper tray 3 and inserted into the outer case 2 by a paper feeding mechanism (not shown) toward the platen 5. The fed recording sheet is discharged out of the outer case 2 from a discharge tray 4 by the paper feeding mechanism.

A guide member 6 is arranged in the outer case 2 parallel to the longitudinal direction of the platen 5. A carriage 7 is supported by the guide member 6 so as to be movable along the guide member 6. A carriage motor (not shown) is arranged in the outer case 2. The carriage motor drives the carriage 7 with a timing belt reeved around a pair of pulleys (none shown). By means of this structure, when the carriage motor is driven, the drive force is transmitted to the carriage 7 by the timing belt to move the carriage 7 in a reciprocating manner parallel to the longitudinal direction of the platen 5 while being supported by the guide member 6.

Figure 5:
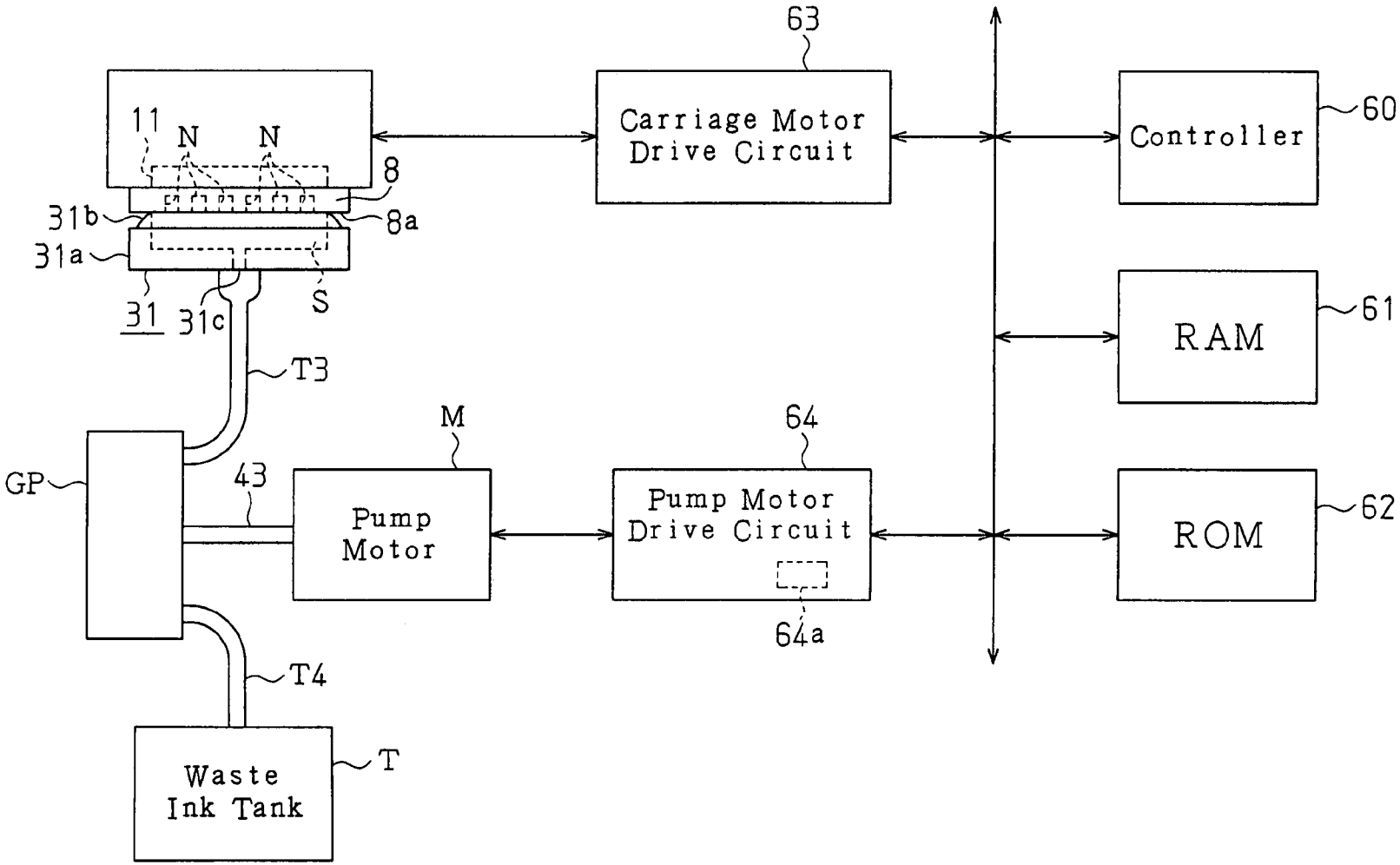
FIG. 5 is a block diagram illustrating the electrical structure of the printer shown in FIG. 1.

A recording head 8, functioning as a liquid ejection head, is installed on the bottom surface of the carriage 7 (the surface facing the platen 5). The recording head 8 has six rows of nozzles, each configured by a plurality of nozzles N (refer to FIG. 5), and the nozzles N open at a nozzle opening surface 8*a* (refer to FIG. 5). To facilitate the description, only some of the nozzles N are shown in FIG. 5.

As shown in FIG. 1, first and second ink cartridges 9 and 10, which serve as ink tanks, supply ink, which serves as liquid, to the recording head 8 via supply tubes T1 and T2, respectively. The first and second ink cartridges 9 and 10 are arranged in the outer case 2. The ink supplied to the recording head 8 is pressurized by piezoelectric elements (not shown) and ejected as ink droplets from the nozzles N onto the recording sheet to perform printing.

Figure 2:
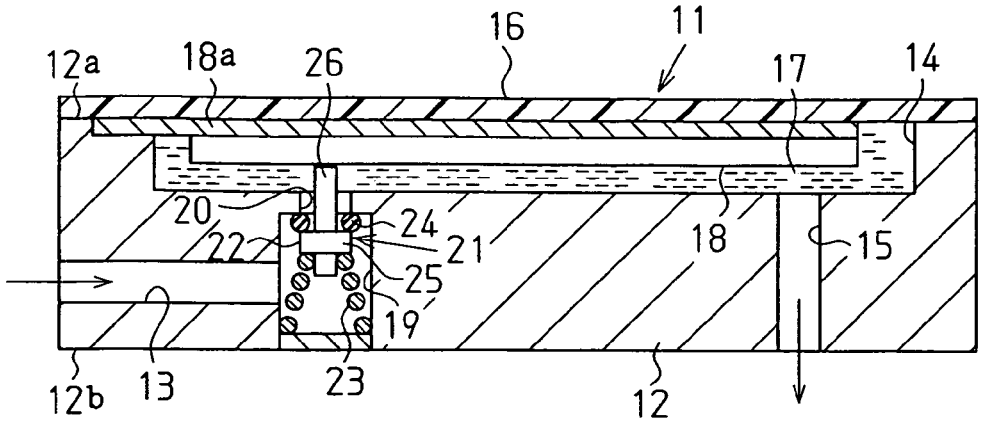
FIG. 2 is a cross-sectional view showing a valve device installed in the printer shown in FIG. 1.

A valve device 11, which is shown in FIG. 2, is installed in the carriage 7. The valve device 11 is provided in the same quantity as that of the nozzle rows (six in the present embodiment) in correspondence with each type of ink. The valve device 11 is arranged in an ink flow passage between the nozzles N and the first and second ink cartridges 9 and 10 so as to supply ink to the nozzles N in accordance with the ink ejection amount of the nozzles N.

As shown in FIG. 2, the valve device 11 includes a flow passage formation member 12. An inlet 13, a channel-like flow passage 14, and a discharge port 15 are formed in the flow passage formation member 12. The channel-like flow passage 14 has an opening in a top surface 12*a*, and the opening is sealed by adhering a film member 16, which functions as a flexible member. The film member 16 is a film having a multi-layer structure of a polyethylene film, nylon film, and the like and has gas barrier properties. A pressure chamber 17 is defined between the inner surface of the channel-like flow passage 14 and the inner surface of the film member 16 by adhering the film member 16 to the opening of the channel-like flow passage 14.

An actuation lever 18 is arranged on the film member 16 at the side of the pressure chamber 17. The actuation lever 18 is formed by a single thin plate and bent to have a channel-like cross-section with the exception of one end 18*a*. The end 18*a* is supported by the flow passage formation member 12 such that the actuation lever 18 is cantilevered. The film member 16 is displaced toward the pressure chamber 17 or the outer side by the pressure difference between the inner and other side of the pressure chamber 17.

First and second supply ports 19 and 20 are formed between the inlet 13 and channel-like flow passage 14. The first supply port 19 is located at the upstream side of the second supply port 20 (side of the inlet 13). The inner diameter of the first supply port 19 is larger than the inner diameter of the second supply port 20. A pressure reduction valve 21 is arranged in the first and second supply ports 19 and 20.

The pressure reduction valve 21 includes a pressure adjustment spring 23 and a seal member 24. The valve body 22 is provided with a shutter 25 and an actuation piece 26. The shutter 25 includes a disk that is large enough to close the second supply port 20 and a projection formed on the disk. The actuation piece 26 is cylindrical and formed integrally with the shutter 25. The outer diameter of the actuation piece 26 is smaller than the inner diameter of the second supply port 20. The pressure adjustment spring 23 is arranged between the shutter 25 of the valve body 22 and an inner surface in the first supply port 19. The pressure adjustment spring 23 applies elastic force to the valve body 22 so as to arrange the shutter 25 at a position (valve closing position) at which the shutter 25 closes the second supply port 20 when external force is not applied to the valve body 22. The urging force of the pressure adjustment spring 23 arranges the valve body 22 at a position inside the first supply port 19 while the actuation piece 26 extends through the second supply port 20 and out of the pressure chamber 17.

An elastomer seal member 24 is arranged on the side surface facing toward the second supply port 20 of the shutter 25. The seal member 24 is an O-ring that is elastically deformed between the shutter 25 and the inner surface of the first supply port 19 to block the flow of ink between the first and second supply ports 19 and 20 when the valve body 22 is moved to the valve closing position due to the urging force of the pressure adjustment spring 23.

When the ink in the pressure chamber 17 of the valve device 11 is supplied to the recording head 8 through the discharge port 15, the ink in the pressure chamber 17 is consumed and the interior pressure decreases such that the film member 16 is inwardly displaced. When the actuation lever 18 of the film member 16 presses the actuation piece 26 of the valve body 22 due to the displacement of the film member 16, the valve body 22 moves to a valve opening position against the urging force of the pressure adjustment spring 23. When the valve body 22 moves to the valve opening position, the shutter 25 is separated from the inner surface in the first supply port 19 so as to connect the first and second supply ports 19 and 20. As a result, ink supplied from the upstream portion (that is, the portion at the side of the first and second ink cartridges 9 and 10) of the valve device 11 is supplied into the pressure chamber 17 through the inlet 13 and the first and second supply ports 19 and 20.

When a predetermined amount of ink is supplied into the pressure chamber 17 and the pressure inside the pressure chamber 17 becomes greater than or equal to a predetermined pressure, the film member 16 is displaced outward (in a direction that increases the volume of the pressure chamber 17). When the film member 16 is displaced outward until the actuation lever 18 is separated from the valve body 22, the valve body 22 is urged to the valve closing position by the urging force of the pressure adjustment spring 23, and the first and second supply ports 19 and 20 are disconnected. Thus, the valve device 11 functions as a self-sealing valve that opens and closes in accordance with the amount of ink in the pressure chamber 17 even without an actuator.

A head maintenance mechanism will now be described. As shown in FIG. 1, a cap device 30, which functions as a cap means forming the head maintenance mechanism, is arranged at a non-printing region in the outer case 2. The cap device 30 includes a cap 31 and a cap elevation mechanism (not shown). As shown in FIG. 5, the cap 31 includes a box portion 31*a*, having an open top, and a seal portion 31*b* formed integrally with the open part of the box portion 31*a*. The seal portion 31*b* is formed of an elastomer.

If the carriage 7 drives and moves the recording head 8 to above the cap 31 (home position) when the printer 1 suspends printing, the cap 31 is driven by the cap elevation mechanism and arranged at an operation position. When the cap 31 moves to the operation position, the seal portion 31*b* is elastically deformed by contact with the nozzle opening surface 8*a*. Thus, the cap 31 seals a space S defined by the inner surface of the cap 31 and the nozzle opening surface 8*a*. When printing restarts, the cap 31 is moved from the operation position to a retracted position by the cap elevation mechanism and separated from the nozzle opening surface 8*a*.

A communication port 31*c* is formed in the bottom part of the box portion 31*a* of the cap 31. The communication port 31*c* connects the interior space of the cap 31 with the exterior. A gear pump GP is connected to the communication port 31*c* as a suction means, a suction pump, and a rotation volume pump.

Figure 3:
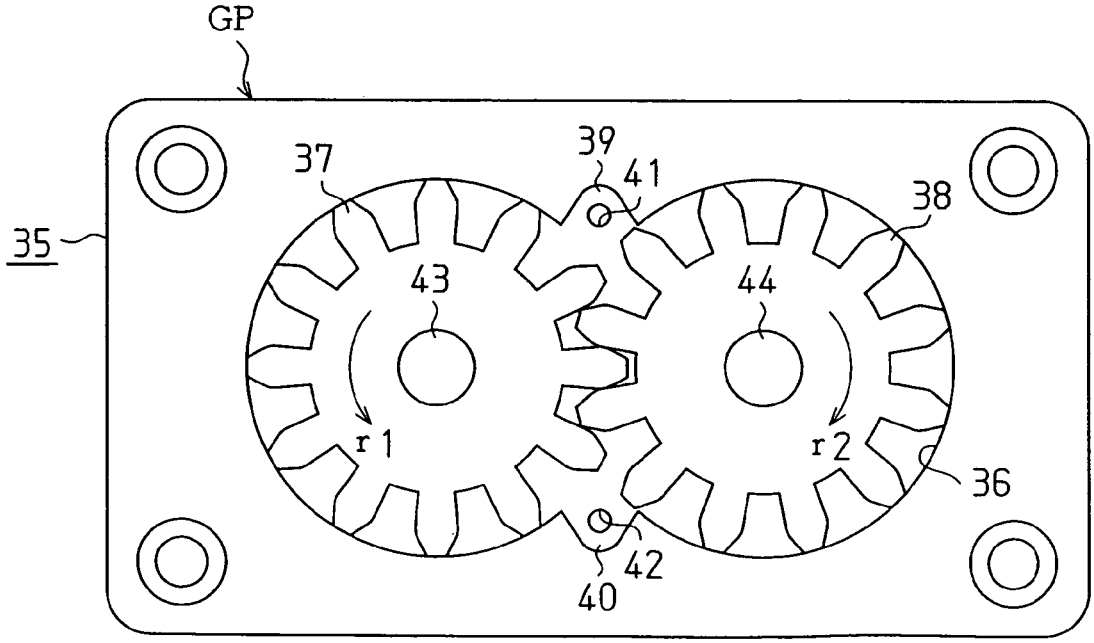
FIG. 3 is a plan view showing the internal structure of the gear pump installed in the printer of FIG. 1.
Figure 4:
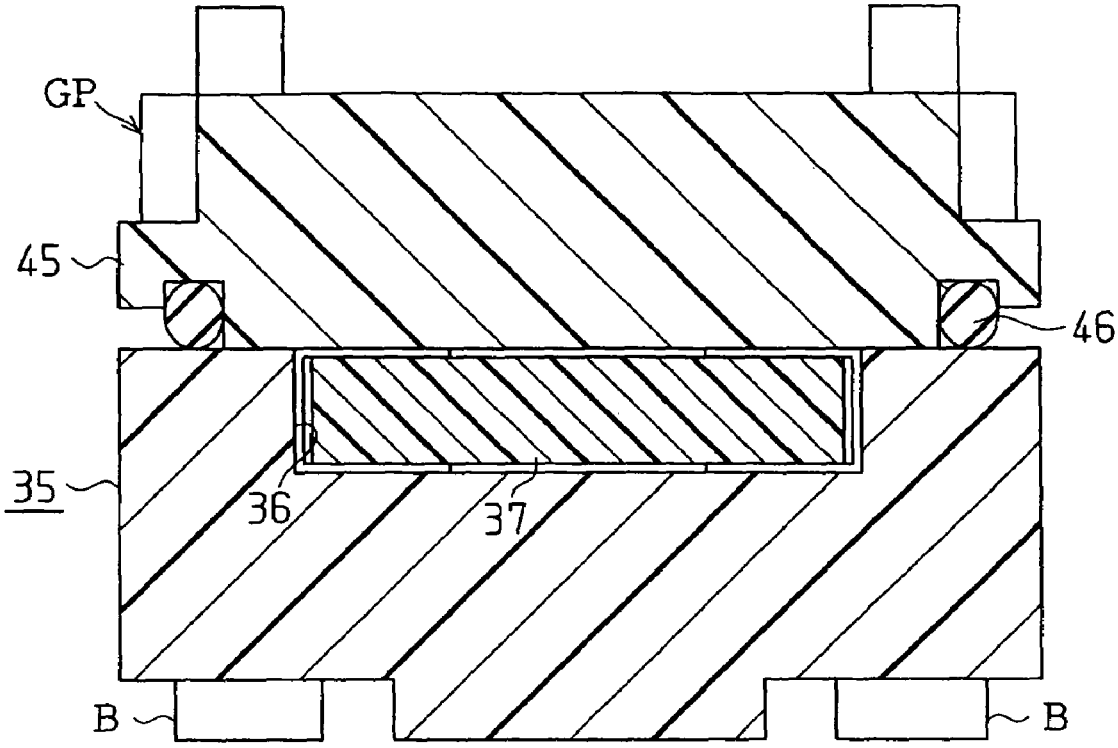
FIG. 4 is a cross-sectional view of the gear pump shown in FIG. 3.

The gear pump GP will now be described with reference to FIGS. 3 and 4. FIG. 3 is a plan view showing the internal structure of the gear pump GP, and FIG. 4 is a cross-sectional view of the gear pump GP. The gear pump GP includes a housing 35 and an accommodation chamber 36 defined in the housing 35. A drive gear 37 and a driven gear 38 are accommodated in the accommodation chamber 36 in a meshed state. A suction chamber 39 and a discharge chamber 40 are formed in the accommodation chamber 36 by the drive gear 37 and the driven gear 38. A suction port 41 is formed in the bottom surface of the suction chamber 39. The suction port 41 extends through the housing 35 and is connected to the cap 31 by a connection tube T3. A discharge port 42 is formed in the bottom surface of the discharge chamber 40. The discharge port 42 extends through the housing 35 and is connected to the exterior.

The drive gear 37 is supported by a drive shaft 43, which is supported by the housing 35. The drive shaft 43 is connected to a pump motor M shown in FIG. 5. As shown in FIG. 3, the driven gear 38 is supported by a driven shaft 44. With this structure, when the drive shaft 43 is rotated by the pump motor M, the drive gear 37 and driven gear 38 are respectively rotated in arrow directions r1 and r2. As a result, ink in the suction chamber 39 is confined between the gear grooves of the gears 37 and 38 and the inner surface of the accommodation chamber 36 so as to be delivered to the discharge chamber 40.

As shown in FIG. 4, an upper cover 45 is arranged on the housing 35 so as to close the opening of the accommodation chamber 36. Bolt B and nuts (not shown) fasten the upper cover 45 to the housing 35. A ring-like packing 46 formed of an elastomer is press-fitted to the inner surface of the cover 45. When the upper cover 45 is arranged on the housing 35, the packing 46 is arranged is a manner surrounding the periphery of the accommodation chamber 36 and squeezed between the upper cover 45 and the housing 35. The packing 46 hermetically seals the accommodation chamber 36 to prevent leakage of ink from the accommodation chamber 36. At least part of the drive gear 37 and driven gear 38 slides along the inner surface of the upper cover 45.

When ink is delivered from the suction chamber 39 to the discharge chamber 40 by the rotation of the drive gear 37 and the driven gear 38, the pressure of the discharge chamber 40 becomes higher than the suction chamber 39. Therefore, a backflow of ink from the discharge chamber 40 to the suction chamber 39 tends to occur through the space between the top surfaces of the gears 37 and 38 and the upper cover 45, the space between the bottom surfaces of the gears 37 and 38 and the bottom surface of the accommodation chamber 36, and the space between the teeth tips of the gears 37 and 38 and the inner surface of the accommodation chamber 36. In the present embodiment, space such as the space between the gears 37 and 38 and the upper cover 45 is reduced so that it does not affect the suction capability of the gear pump GP.

If the gear pump GP is driven by the pump motor M when the cap 31 seals the nozzle opening surface 8*a* as shown in the state of FIG. 5, the fluid (ink, air or the like) in the connection tube T3 and the cap 31 is discharged to the gear pump GP. This reduces the pressure in the cap 31 and accumulates negative pressure in the space S. When the pressure in the space S of the cap 31 decreases and becomes less than or equal to a predetermined value, ink and bubbles in the nozzle N of the recording head 8 and ink adhered to the nozzle opening surface 8*a* are suctioned into the cap 31 so as to perform a so-called head cleaning operation. Thus, the viscid ink in the nozzles N, bubbles, and ink and dust adhered to the nozzle opening surface 8*a* are suctioned out so as to prevent printing deficiencies of the printer 1.

The fluid delivered from the cap 31 to the gear pump GP is sent to a waste ink tank T (refer to FIGS. 1 and 5) through a waste tube T4 (refer to FIG. 5) connected to the discharge port 42 of the gear pump GP. The end of the discharge tube T4 at the side of the waste ink tank T is open to the atmosphere. Therefore, the discharge chamber 40 is maintained at a pressure close to atmospheric pressure.

The main parts of the electrical structure of the printer 1 will now be described with reference to FIG. 5. A controller 60 generates print data based on image data output from a terminal (not shown) connected to the printer 1 or output an external storage medium reader of the printer 1 and drives the recording head 8 and the like based on the print data. The controller 60 outputs signals to a carriage motor drive circuit 63 and a pump motor drive circuit 64, which functions as a detection means, in accordance with a cleaning program stored in a RAM 61 or ROM 62. The carriage motor drive circuit 63 drives the carriage motor in accordance with signals from the controller 60.

The pump motor drive circuit 64 drives the pump motor M at first and second motor rotation speeds in accordance with the signals from the controller 60. When the pump motor M is driven, the gear pump GP is driven at the first and second rotation speeds by the drive shaft 43. The pump motor drive circuit 64 detects the torque load on the pump motor M.

The head cleaning operation performed by the printer 1 will now be described. When a cleaning start command is output from a cleaning detection means (not shown) to the controller 60, the controller 60 outputs a signal to the carriage motor drive circuit 63 and moves the carriage 7 to the home position. The cap elevation mechanism follows the movement of the carriage 7 and moves the cap 31 from the retracted position to the operation position. As a result, the nozzle opening surface 8*a* is hermetically sealed by the cap 31 in the recording head 8 on the carriage 7 arranged at the home position. The cleaning detection means is a switch or the like arranged in the printer 1.

The controller 60 outputs signals to a pump motor drive circuit 64 in accordance with a cleaning program stored in a RAM 61 or ROM 62 to drive the pump motor M at the first motor rotation speed. When the pump motor M is rotated at the first motor rotation speed, the gear pump GP is driven at the first rotation speed (main suction). As a result, the fluid in the cap 31, which seals the nozzle opening surface 8*a*, and the liquid in the connection tube T3 are discharged to the gear pump GP. This lowers the pressure in the cap 31 to a negative pressure state. When the internal pressure of the cap 31 becomes less than or equal to a predetermined pressure P1, the ink and bubbles in the nozzles N of the recording head 8 and the ink and dust adhered to the nozzle opening surface 8*a* are suctioned out to the cap 31 by the increase in the pressure difference between the inside of the cap 31 and the upstream portion of the nozzles N (the portion of the nozzles N at the side of the valve device 11). At this time, the gear pump GP is driven such that the suction amount from the cap 31 per unit time becomes equal to a first suction amount.

When the ink and the like are discharged from the nozzles N, the ink in the discharge port 15 and pressure chamber 17 of the valve device 11 is supplied to the nozzles N. As a result, the ink in the pressure chamber 17 decreases and gradually displaces the film member 16 inwardly. When the actuation lever 18 contacts the actuation piece 26 of the valve body 22, the valve body 22 moves to the valve open position and connects the first and second supply ports 19 and 20.

Fluid is continuously discharged into the cap 31 from the nozzles N. However, the internal pressure of the cap 31 is maintained at a pressure (negative pressure) enabling suction of fluid from the nozzles N by driving the gear pump GP at the first rotation speed. That is, the first rotation speed of the gear pump GP cancels pressure increases in the cap 31 that would be caused by the discharge of fluid into the cap 31, and the internal pressure of the cap 31 is set so as to maintaining the negative pressure state enabling fluid suction from the nozzles N.

Therefore, the fluid discharged into the cap 31 from the nozzles N flows into the gear pump GP through the connection tube T3. When fresh ink flows into the gear pump GP, the pressure in the suction chamber 39 temporarily increases. This increases the torque load for driving the gear pump GP. At this time, when the torque load on the gear pump GP becomes greater than or equal to a predetermined torque load, the detection circuit 64*a* of the pump motor drive circuit 64 sends a detection signal to the controller 60. The controller 60 sends a signal to the pump motor drive circuit 64 after a predetermined time elapses from when the signal has been received from the detection circuit 64*a* of the pump motor drive circuit 64. Then, the pump motor drive circuit 64 rotates the pump motor M at the second motor rotation speed (pressure adjustment suction). The second motor rotation speed is set to be lower than the first motor rotation speed. The predetermined time is the time required from when driving of the gear pump GP starts at the first rotation speed for the main suction to be performed and the amount of discharged ink becomes sufficient for preventing clogging. This time is calculated through experiments beforehand.

When the pump motor M is rotated at the second motor rotation speed, the gear pump GP is driven at the second rotation speed, which is lower than the first rotation speed. This changes the rotation speeds of the drive gear 37 and driven gear 38 in a decreasing direction and raises the internal pressure of the suction chamber 39 compared to when the pump rotor M was driven at the first rotation speed. As a result, the suction amount of the fluid suctioned from the cap 31 per unit time becomes equal to a second suction amount. The second suction amount is less than the first suction amount of the main suction.

When the gear pump GP is being driven at the first rotation speed, the suction amount of the fluid per unit time is large. Thus, the pressure chamber 17 of the valve device 11 is in a low pressure state. In this state, the film member 16 is greatly deformed in an elastic manner. Thus, when the gear pump GP stops suddenly, the film member 16 is elastically restored. This may suction a volume corresponding to the elastically deformed portion into the pressure chamber 17. In contrast, when the gear pump GP is being driven at the second rotation speed, the pressure chamber 17 of the valve device 11 is in a low negative pressure state. Therefore, the elastic deformation amount of the film member 16 is small, and even if fluid is suctioned into the pressure chamber 17 from the nozzles N when the gear pump GP stops, the volume of the suctioned fluid is small.

If a predetermined time elapses from when the controller 60 sends the to the pump motor drive circuit 64 for driving the motor M at the second motor rotation speed, the controller 60 outputs a signal to the pump motor drive circuit 64. The predetermined time is the time from when the gear pump GP starts rotating at the second rotation speed to when the pressure in the cap 31 reaches a predetermined pressure P2 and is calculated through experiments beforehand. When receiving this signal, the pump motor drive circuit 64 stops driving the pump motor M. As the pump motor M stops, the gear pump GP stops.

In this state, due to the negative pressure state in the cap 31, the discharge of ink from the nozzles N continues. As a result, the internal pressure of the cap 31 gradually increases and approaches atmospheric pressure since ink is supplied from the nozzles N. Then, the pressure difference between the interior pressure of the cap 31 and the pressure of the portion upstream from the nozzles N (the portion at the side of the valve device 11) gradually decreases, and the discharge of ink from the nozzles N stops when the interior pressure of the cap 31 reaches the predetermined pressure P2 (less than predetermined pressure P1), which disables the suction of ink from the nozzles N.

The interior of the pressure chamber 17 of the valve device 11 is filled with ink supplied from the portion upstream from the ink flow passage-upstream of the valve device 11 by stopping the discharge of ink from the nozzles N, and the film member 16 is restored to a position that does not contact the valve body 22. Thus, the valve body 22 moves to the valve closing position, and the valve device 11 becomes closed. At this time, ink supplied from the valve device 11 fills the nozzles N, and the pressure therein approaches the atmospheric pressure. The ink in the nozzles N forms a semi-spherical ink surface (meniscus) on the nozzle opening surface 8*a* when the discharge of ink from the nozzle N ends.

The pressure in the space S of the cap 31 and the suction chamber 39 of the gear pump GP approaches atmospheric pressure. Therefore, backflow of fluid to the cap 31 is prevented from the discharge chamber 40, which is at the atmospheric pressure, through the gap between the gears 37 and 38 and the upper cover 45 and the gap between the gears 37 and 38 and the inner surface of the accommodation chamber 36.

Accordingly, the pressure in the cap 31 does not suddenly rise since there is almost no backflow of fluid from the gear pump GP to the cap 31. Thus, the fluid discharged into the cap 31 from the nozzles N is not suctioned into the nozzles N again due to an increase in the pressure difference between the portion upstream to the flow passage of the nozzles N and the interior of the cap 31 caused by the backflow of fluid to the cap 31. This prevents color mixing of ink and the mixing of bubbles or the like in the nozzles N. Further, the meniscus of the ink in the nozzles N is maintained in a satisfactory state without being disrupted.

When the driving of the gear pump GP stops, the controller 60 determines whether or not to continue printing. When shifting to a printing suspension state, the nozzle opening surface 8*a* of the recording head 8 is held in a sealed state by the cap 31 to prevent the interior of the nozzles N from drying. When continuing printing, the controller 60 sends a signal to the carriage motor drive circuit 63. The carriage motor drive circuit 63 drives the carriage motor in accordance with the signal and moves the carriage 7 from the home position to the printing region. When the carriage 7 moves to the printing region, the cap elevation mechanism follows the movement of the carriage 7 and moves the cap 31 from the operation position to the retracted position. As a result, the cap 31 is separated from the nozzle opening surface 8*a*, and the head cleaning ends.

The above embodiment has the advantages described below.

(1) In the present embodiment, during head cleaning, the gear pump GP is first rotated at the first rotation speed after the cap 31 seals the nozzle opening surface 8*a* of the recording head 8. Due to the driving of the gear pump GP at the first rotation speed, the interior of the cap 31 sealing the nozzle opening surface 8*a* has a pressure enabling the suction of fluid from the nozzles N (main suction).

Further, after the gear pump GP has been driven for a predetermined time at the first rotation speed, the gear pump GP is driven at the second rotation speed, which is lower than the first rotation speed, and the gear pump GP is then stopped. That is, after the suction of fluid from the nozzles N, the driving of the gear pump GP does not stop immediately. Rather, the gear pump GP is stopped after being driven at the second rotation speed. Therefore, after the main suction, the gear pump GP is stopped after the negative pressure state in the cap 31 is mitigated. As a result, when the gear pump GP stops, backflow of fluid from the discharge portion of the gear pump GP to the cap 31 through the gaps in the gear pump GP is prevented. Since a sudden increase in the pressure in the cap 31 that would be caused by a backflow of fluid is prevented, the fluid in the cap 31 is prevented from entering the nozzles N, and ink is prevented from adhering to the nozzle opening surface 8*a*. Accordingly, disruption of the meniscus of the ink in the nozzles N is prevented.

(2) In the above embodiment, the suction means for suctioning the fluid in the cap 31 is formed by the gear pump GP. Therefore, the suction amount from the cap 31 may be changed by just changing the rotation speed of the gear pump GP. Furthermore, a relatively large negative pressure is generated in the portion upstream to the gear pump GP and the pump size may be reduced.

(3) In the above embodiment, the pump motor drive circuit 64 includes the detection circuit 64*a*, and the detection circuit 64*a* detects the torque load of the pump motor M. Therefore, the flow of fluid into the gear pump GP from the cap 31 is detected by the increase in the torque load of the gear pump GP. Accordingly, fluid is discharged from the recording head 8, and the rotation speed of the gear pump GP is changed from the first rotation speed to the second rotation speed when the fluid discharged from the recording head 8 flows into the gear pump GP. Since the pump speed changes after the main suction is definitely performed, the reliability of the head cleaning operation is improved.

(4) In the above embodiment, the valve device 11 is arranged upstream from the nozzles N of the recording head 8 in the ink flow passage. The valve device 11 includes the pressure chamber 17 for storing ink supplied to the nozzles N, the film member 16 displaced by the pressure difference between the inside and outside of the pressure chamber 17, and the pressure reduction valve 21 opened and closed by the displacement of the film member 16. The valve device 11 opens and closes in accordance with the pressure difference between the interior and exterior of the pressure chamber 17 without an actuator that uses electrical power as a drive source. Thus, the thickness of the valve device 11 may be reduced.

After the gear pump GP performs the main suction at a first rotation speed, the gear pump GP mitigates the negative pressure in the cap 31 through pressure adjustment suction at a second rotation speed. The pressure adjustment suction mitigates the negative pressure of the pressure chamber 17 in the valve device 11, reduces the amount of elastic deformation of the film member 16, and prevents the backflow of the fluid in the cap 31 to the valve device 11.

The above embodiment may be modified as described below.

In the above embodiment, when the gear pump GP is driven a predetermined time at the second rotation speed, the internal pressure of the cap 31 reaches the predetermined pressure P2 and stops the discharge of fluid from the nozzles N of the recording head 8. However, the predetermined pressure P2 may be a pressure that continues the discharge operation of the nozzles N. It is only necessary that the second rotation speed prevents backflow of fluid from the gear pump GP to the cap 31 when the gear pump GP stops.

After the pressure adjustment suction and following the driving of the gear pump GP for a predetermined time at the second rotation speed, the gear pump GP may be driven at a third rotation speed that is lower than the second rotation speed. This further ensures the prevention of a backflow when using a pump that tends to produce a backflow.

The gear pump GP also be used as a pressurizing pump in addition to a suction pump. For example, fluid (air, ink) discharged by the gear pump GP may be delivered to an ink cartridge provided with the function of a waste ink tank. In this case, in the liquid delivered from the gear pump GP, only the waste ink is absorbed by an absorption member accommodated in the ink cartridge, and air is filled into the case of the ink cartridge. That is, in this case, the gear pump GP functions as a pressurizing pump for delivering fluid to the ink cartridge. As a result, when an ink pack made of a flexible material is accommodated in the ink cartridge, the air filling the case squeezes the ink pack and forces ink out of the ink pack and toward the recording head 8. In such a case, the gear pump GP is driven at the second rotation speed before it stops. This makes it difficult for a pressure difference to be generated between the discharge chamber 40 and the suction chamber 39 of the gear pump GP. Thus, it is difficult to for a backflow of fluid from the ink cartridge to the discharge chamber 40 of the gear pump GP to be produced.

The detection circuit 64*a* of the pump motor drive circuit 64 need not be provided with the function for detecting the torque load of the pump motor M. This facilitates control during the head cleaning.

The detection circuit 64*a* of the pump motor drive circuit 64 may send the present detection signal to the controller 60 so that the controller 60 calculates the present torque load. The detection circuit 64*a* switches the rotation speed of the gear pump GP when the torque load calculated by the controller 60 becomes greater than or equal to a predetermined value or when a predetermined time elapses when the torque load becomes greater than or equal to the predetermined value.

A projection that slides along the bottom surface of the accommodation chamber 36 or the inner surface of the upper cover 45 may be formed on the drive gear 37 and driven gear 38. In this case, the gears 37 and 38 abut against the upper cover 45 or the housing 35 and reduces load during rotation by decreasing the slide area while reducing the gap between the upper cover 45 and the housing 35.

In the above embodiment, a printer for ejecting ink is described as the liquid ejector. However, other liquid ejectors may be used as the liquid ejector. For example, the liquid ejector may be printing device, such as a facsimile or a copier; a liquid ejector that ejects liquid, such as an electrode material, a colorant, or the like, for manufacturing liquid crystal displays, EL displays, and surface emitting displays; a liquid ejector that ejects a bio-organic material used to manufacture bio chips; or a sample ejection device that functions as a precision pipettes. The fluid (liquid) is not limited and other fluids (liquid) may be used.

What is claimed is:

1. A liquid ejector comprising:

a liquid ejection head including a nozzle for ejecting a liquid;

a cap device for sealing the liquid ejection head;

a gear pump, connected to the cap device, for generating negative pressure and discharging fluid out of the liquid ejection head with the negative pressure in a state in which the cap device seals the liquid ejection head, wherein the liquid ejector:

suctions fluid from the cap device with the gear pump so that a suction amount of the fluid per unit time becomes equal to a first suction amount in order to discharge fluid from the nozzle; and continuously afterwards, suctions fluid from the cap device by changing the suction amount of the fluid per unit time from the first suction amount to a smaller second suction amount, wherein the gear pump is driven at a first rotation speed so that the fluid in the cap device is suctioned in the first suction amount, and continuously afterwards, driven at a second rotation speed, which is lower than the first rotation speed, so that the fluid in the cap device is suctioned in the second suction amount.

2. The liquid ejector according to claim 1, further comprising:

a flow passage for guiding liquid to the nozzle; and a valve device arranged upstream from the nozzle in the flow passage;

wherein the valve device includes a pressure chamber, for storing liquid, and a flexible member, displaced in accordance with a pressure difference between an interior and exterior of the pressure chamber, and the valve device opens and closes based on the displacement of the flexible member.

3. The liquid ejector according to claim 1, wherein the gear pump includes a housing and two gears accommodated in the housing.

4. The liquid ejector according to claim 3, further comprising:

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

5. The liquid ejector according to claim 1, further comprising:

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

6. A liquid ejector comprising:

a liquid ejection head including a nozzle for ejecting a liquid;

a cap device for sealing the liquid ejection head;

a gear pump, connected to the cap device, for generating negative pressure and discharging fluid out of the liquid ejection head with the negative pressure in a state in which the cap device seals the liquid ejection head, wherein the liquid ejector:

suctions fluid from the cap device with the gear pump so that a suction amount of the fluid per unit time becomes equal to a first suction amount in order to discharge fluid from the nozzle; and continuously afterwards, suctions fluid from the cap device by changing the suction amount of the fluid per unit time from the first suction amount to a smaller second suction amount, wherein the gear pump is driven so that the suction amount per unit time becomes equal to the first suction amount in order to discharge fluid from the nozzle, and continuously afterwards, is driven so that the suction amount per unit time becomes equal to the second suction amount per unit time, and then stops, the liquid ejector further comprising:

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

7. The liquid ejector according to claim 6, further comprising:

a flow passage for guiding liquid to the nozzle; and a valve device arranged upstream from the nozzle in the flow passage;

wherein the valve device includes a pressure chamber, for storing liquid, and a flexible member, displaced in accordance with a pressure difference between an interior and exterior of the pressure chamber, and the valve device opens and closes based on the displacement of the flexible member.

8. A liquid ejector comprising:

a liquid ejection head including a nozzle for ejecting a liquid;

a cap device for sealing the liquid ejection head;

a gear pump, connected to the cap device, for generating negative pressure and discharging fluid out of the liquid ejection head with the negative pressure in a state in which the cap device seals the liquid ejection head, wherein the liquid ejector:

suctions fluid from the cap device with the gear pump so that a suction amount of the fluid per unit time becomes equal to a first suction amount in order to discharge fluid from the nozzle; and continuously afterwards, suctions fluid from the cap device by changing the suction amount of the fluid per unit time from the first suction amount to a smaller second suction amount, wherein the gear pump includes a housing and two gears accommodated in the housing, the liquid ejector further comprising;

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

9. The liquid ejector according to claim 8, further comprising:

a flow passage for guiding liquid to the nozzle; and a valve device arranged upstream from the nozzle in the flow passage;

wherein the valve device includes a pressure chamber, for storing liquid, and a flexible member, displaced in accordance with a pressure difference between an interior and exterior of the pressure chamber, and the valve device opens and closes based on the displacement of the flexible member.

10. A liquid ejector comprising:

a liquid ejection head including a nozzle for ejecting a liquid;

a cap device for sealing the liquid ejection head;

a gear pump, connected to the cap device, for generating negative pressure and discharging fluid out of the liquid ejection head with the negative pressure in a state in which the cap device seals the liquid ejection head, wherein the liquid ejector:

suctions fluid from the cap device with the gear pump so that a suction amount of the fluid per unit time becomes equal to a first suction amount in order to discharge fluid from the nozzle; and continuously afterwards, suctions fluid from the cap device by changing the suction amount of the fluid per unit time from the first suction amount to a smaller second suction amount, the liquid ejector further comprising:

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

11. The liquid ejector according to claim 10, further comprising:

a flow passage for guiding liquid to the nozzle; and a valve device arranged upstream from the nozzle in the flow passage;

wherein the valve device includes a pressure chamber, for storing liquid, and a flexible member, displaced in accordance with a pressure difference between an interior and exterior of the pressure chamber, and the valve device opens and closes based on the displacement of the flexible member.

12. A liquid ejector comprising:

a liquid ejection head including a nozzle for ejecting a liquid;

a cap device for sealing the liquid ejection head;

a gear pump, connected to the cap device, for generating negative pressure and discharging fluid out of the liquid ejection head with the negative pressure in a state in which the cap device seals the liquid ejection head, wherein the liquid ejector:

suctions fluid from the cap device with the gear pump so that a suction amount of the fluid per unit time becomes equal to a first suction amount in order to discharge fluid from the nozzle; and continuously afterwards, suctions fluid from the cap device by changing the suction amount of the fluid per unit time from the first suction amount to a smaller second suction amount, wherein the gear pump is driven so that the suction amount per unit time becomes equal to the first suction amount in order to discharge fluid from the nozzle, and continuously afterwards, is driven so that the suction amount per unit time becomes equal to the second suction amount per unit time, and then stops, wherein the gear pump includes a housing and two gears accommodated in the housing, the liquid ejector further comprising:

a detector for detecting an increase and decrease in load of the gear pump caused by a flow of fluid into the gear pump and a flow of fluid out of the gear pump;

wherein the gear pump changes the suction amount per unit time from the first suction amount to the second suction amount after the detector detects an increase in the load of the gear pump.

13. The liquid ejector according to 12, further comprising:

a flow passage for guiding liquid to the nozzle; and a valve device arranged upstream from the nozzle in the flow passage;

wherein the valve device includes a pressure chamber, for storing liquid, and a flexible member, displaced in accordance with a pressure difference between an interior and exterior of the pressure chamber, and the valve device opens and closes based on the displacement of the flexible member.

* * * * *